US007308734B2

(12) United States Patent
Mizer, Sr.

(10) Patent No.: US 7,308,734 B2
(45) Date of Patent: Dec. 18, 2007

(54) COTTON SEED CLEANER

(75) Inventor: Mike A. Mizer, Sr., Plano, TX (US)

(73) Assignee: Cantrell Worldwide, Inc., Carrollton, TX (US)

( * ) Notice: Subject to any disclaimer, the term of this patent is extended or adjusted under 35 U.S.C. 154(b) by 423 days.

(21) Appl. No.: 11/073,375

(22) Filed: Mar. 4, 2005

(65) Prior Publication Data

US 2006/0196011 A1 Sep. 7, 2006

(51) Int. Cl.
*D01B 1/04* (2006.01)

(52) U.S. Cl. ..... 19/39; 19/41

(58) Field of Classification Search ..... 19/39–42
See application file for complete search history.

(56) References Cited

U.S. PATENT DOCUMENTS

| | | | | |
|---|---|---|---|---|
| 486,441 | A | 11/1892 | Empson | |
| 856,421 | A | 6/1907 | Patterson | |
| 1,037,340 | A | 9/1912 | Shaughnessy | |
| 1,059,270 | A | 4/1913 | Brown | |
| 1,100,759 | A | 6/1914 | Meurling | |
| 1,284,922 | A | 11/1918 | O'Connell | |
| 1,458,870 | A | 6/1923 | Zoeller | |
| 1,509,359 | A | 9/1924 | Lawson | |
| 1,538,244 | A | 5/1925 | Hopkins | |
| 1,678,210 | A | 7/1928 | Cumpston | |
| 1,680,978 | A | 8/1928 | Garner | |
| 1,777,245 | A | 9/1930 | Arnold, Jr. | |
| 1,886,044 | A | 11/1932 | Quinn et al. | |
| 2,148,184 | A | 2/1939 | Baker | |
| 2,696,025 | A | 12/1954 | Vandergriff | |
| 2,810,163 | A | 10/1957 | Kyame et al. | |
| 2,841,154 | A | 7/1958 | Dearsley | |
| 2,902,722 | A | 9/1959 | Wallace | |
| 3,355,776 | A | 12/1967 | Reddick | |
| 4,005,717 | A | 2/1977 | Brackmann et al. | 131/84 |
| 4,154,021 | A * | 5/1979 | Griffith et al. | 19/41 |
| 4,173,177 | A | 11/1979 | Davis | 99/618 |
| 4,300,267 | A | 11/1981 | Winch et al. | 19/200 |
| 4,499,909 | A | 2/1985 | Seragnoli | 131/84 |
| 4,699,049 | A * | 10/1987 | Mizer | 99/568 |
| 5,176,295 | A | 1/1993 | Stefanik | 222/271 |
| 5,762,171 | A | 6/1998 | Mizer | 19/41 |
| 6,786,438 | B2 * | 9/2004 | Winn | 241/65 |

OTHER PUBLICATIONS

In-Line Hull Beater, High Capacity Separation for the Modern Oil Seeds Processor Manual, Carver, Inc., Nov. 17, 1994.

(Continued)

*Primary Examiner*—Shaun R. Hurley
(74) *Attorney, Agent, or Firm*—Michael A. O'Neil

(57) ABSTRACT

A cotton seed cleaner includes an initial airwash, a shaker deck with a series of cascading shaker trays, and a plurality of pin mill drums for more efficient and thorough cleaning of seeds to be used in industrial and commercial products. The result is a more efficient and cost effective cleaning process of the seeds, yielding cleaner seed and more quality byproducts for use in commercial and industrial products.

19 Claims, 5 Drawing Sheets

OTHER PUBLICATIONS

BC-4 Lint Cleaning Unit, Operation-Maintenance Repair Parts.
Carver, Inc. Parts Manual, 48" 8-Basket Motes Beater Arrangement.
Carver, Inc. 3-High Lint Cleaner, Maximum Recovery of Lint Fiber.
Carver, Inc. Eight Basket Beater—Separator, High Capacity Hull Separator for the Modern Oil Seeds Processor.
Carver, Inc. Repair Parts Catalogue Lint Cleaning Unit.
The Delinting of Cotton Seed, M.C. Verdery, Jun. 1979, pp. 1-132.

* cited by examiner

COTTON SEED CLEANER

TECHNICAL FIELD

This invention relates generally to cotton seed cleaners, and more particularly to an improved apparatus for cleaning cotton seeds prior to subsequent processing.

BACKGROUND AND SUMMARY OF THE INVENTION

Cotton seeds are used in numerous industrial and consumer applications. Cleaned seeds are processed into cottonseed vegetable oil for cooking applications and cottonseed meal for livestock and poultry feed. The byproducts removed during the cleaning of cotton seeds also have several industrial and commercial uses; for example, the hulls are used as roughage for livestock feed and the lint removed is used in several industrial and commercial products.

Referring to FIG. 1 of the drawings, there is shown a conventional cotton seed cleaner 10, comprising a four shaker-tray system. Debris is removed as the seeds drop down through the shaker trays 12, 14, 16 and 18. As the seeds are fed into the shaker tray system, a deflector 19 divides and guides the seeds onto the trays. Larger debris such as sticks, rocks, paper, wood, etc. is removed as the seeds drop through the orifices in the top tray 12. Smaller debris such as loose meats, small stones, small shale, and the like are removed as the seeds drop through the orifices in the second tray 14. Similarly, larger debris items are removed as the seeds fall through the orifices in the third tray 16, and the smaller trash and debris is removed in the bottom tray 18. Once the seeds have passed through the trays and fall through the orifices in the second tray 14 and the bottom tray 18, they are cleaned and ready for processing into commercial and industrial products such as cottonseed oil and livestock feed.

Lint and light shale are removed at each of the four shaker trays along with the other debris, but because of the light weight of the lint and shale, they do not progress down the trays for sorting and further processing as efficiently as the larger, heavier debris. Instead, the lint and light shale get trapped in the orifices at the bottom of the trays, eventually blinding and clogging the orifices altogether and preventing any seed from falling through, thereby lessening the efficiency and speed of the cotton seed cleaner 10. As a result, the cotton seed cleaner 10 must be cleaned and maintained frequently which reduces the efficiency and speed of production, ultimately increasing the cost of production. In addition to the production cost, the trapped lint results in lost profits which could have been realized from the sale of the lint. Further the lint recovered by unclogging the orifices for sale as a byproduct is a lesser quality, less valuable lint byproduct because it has been handled more than the lint removed off of the shaker trays.

The present invention comprises a cotton seed cleaner which overcomes the foregoing and other difficulties which have long since characterized the prior art. In accordance with the broader aspects of the invention, a cotton seed cleaner comprises an initial air wash which removes lint before the seed enters into a cascading shaker tray and subsequent pin mill drum system.

Following the initial air wash, seeds enter a shaker tray system. The shaker tray comprises a plurality of cascading trays which scalps the larger debris and trash from the seeds. Once the larger debris is removed through the shaker tray system, the seeds enter a pin mill drum system, where the seeds are completely fluffed and cleaned of the smallest debris and any embedded hull trash.

Because the lint is removed prior to the seeds entering the shaker trays, the trays are less likely to become clogged with debris, therefore reducing the cleaning and maintenance frequency of all components of the cotton seed cleaner. The cascading shaker trays more effectively remove the larger debris so that when the seeds enter the pin mill system, the only debris remaining on the seeds is the smallest debris and any embedded hull trash. As the seeds proceed through a plurality of pin mill drums, the seeds are fluffed and any remaining debris is removed from therefrom. The smaller lint is then sorted by a vibrating table, where the smaller lint is sorted further and collected for further processing. Not only does the cleaning method of the present invention improve the efficiency and effectiveness of the cleaner, but also enables better collection and sorting of the debris for further processing and sale.

The cotton seed cleaner of the present invention produces cleaner seeds and better byproducts, increasing revenue realized from both the cleaned seeds and the byproducts. In addition to the increased revenue from the sale of raw goods, the decrease in maintenance and cleaning frequencies reduces the operating cost, which positively impacts revenue gains.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
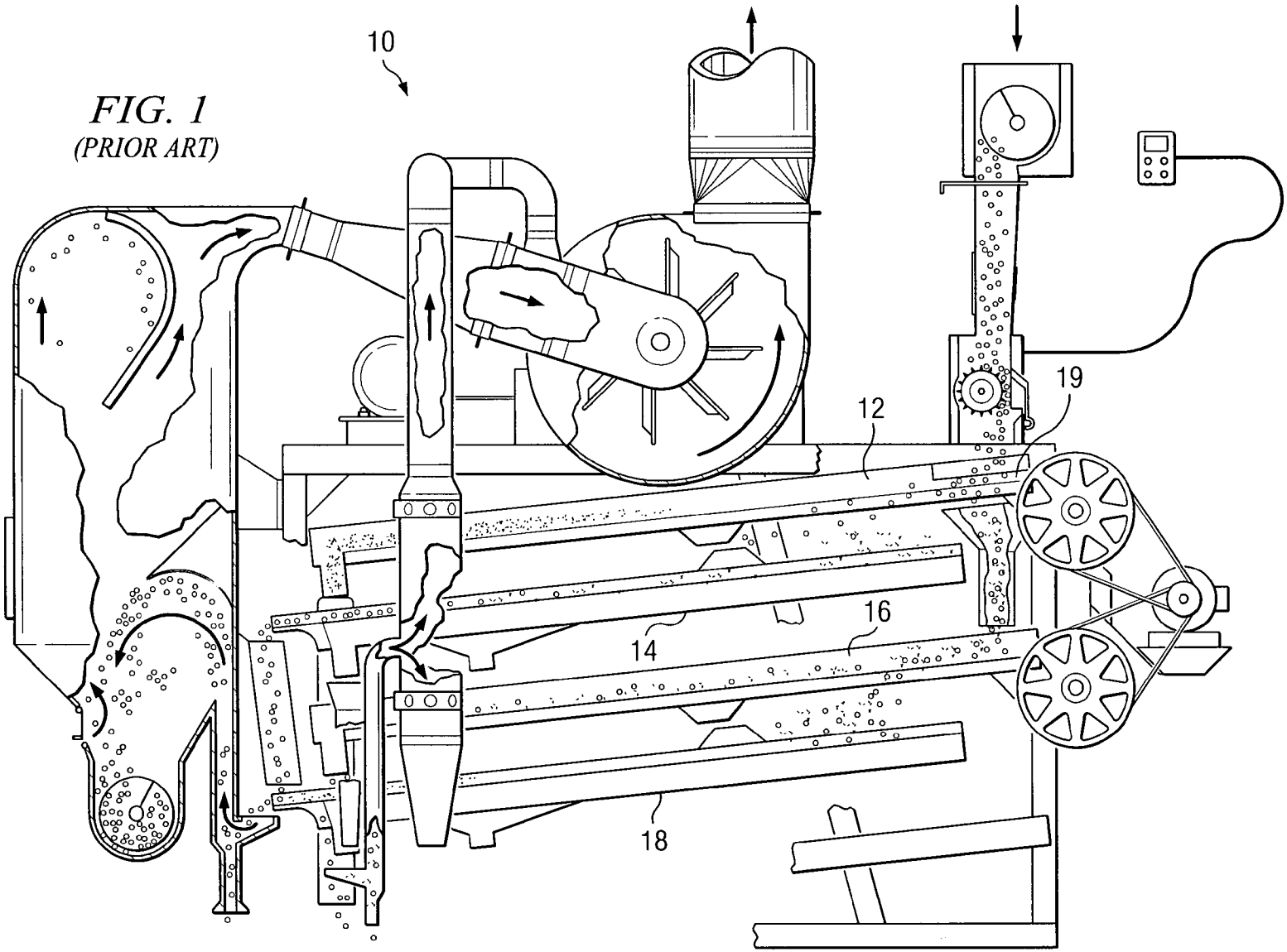
FIG. 1 (PRIOR ART)
FIG. 1 is an illustration of a prior art cottonseed cleaner.
Figure 2:
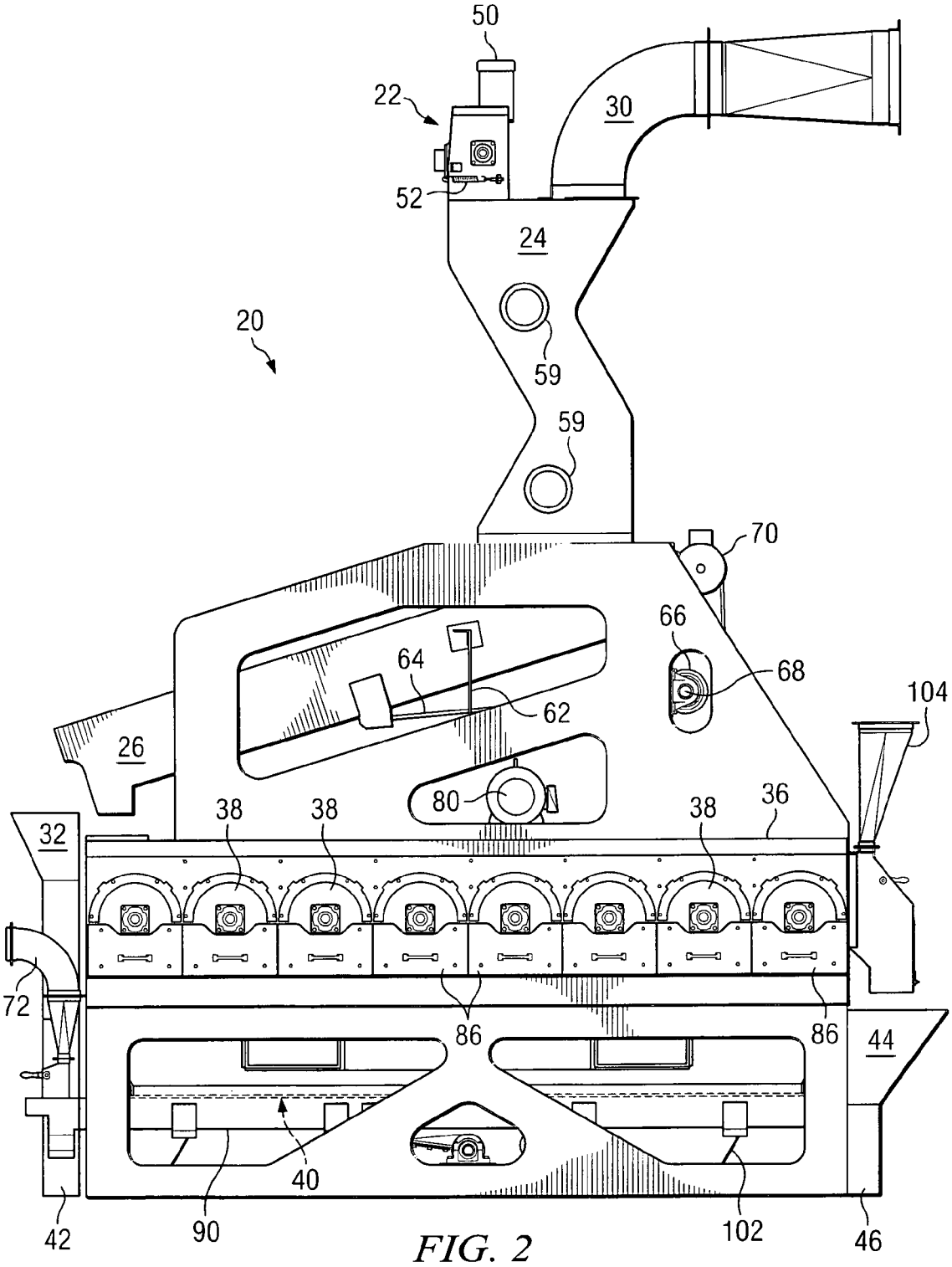
FIG. 2 is an illustration of the preferred embodiment of the present invention.
Figure 3:
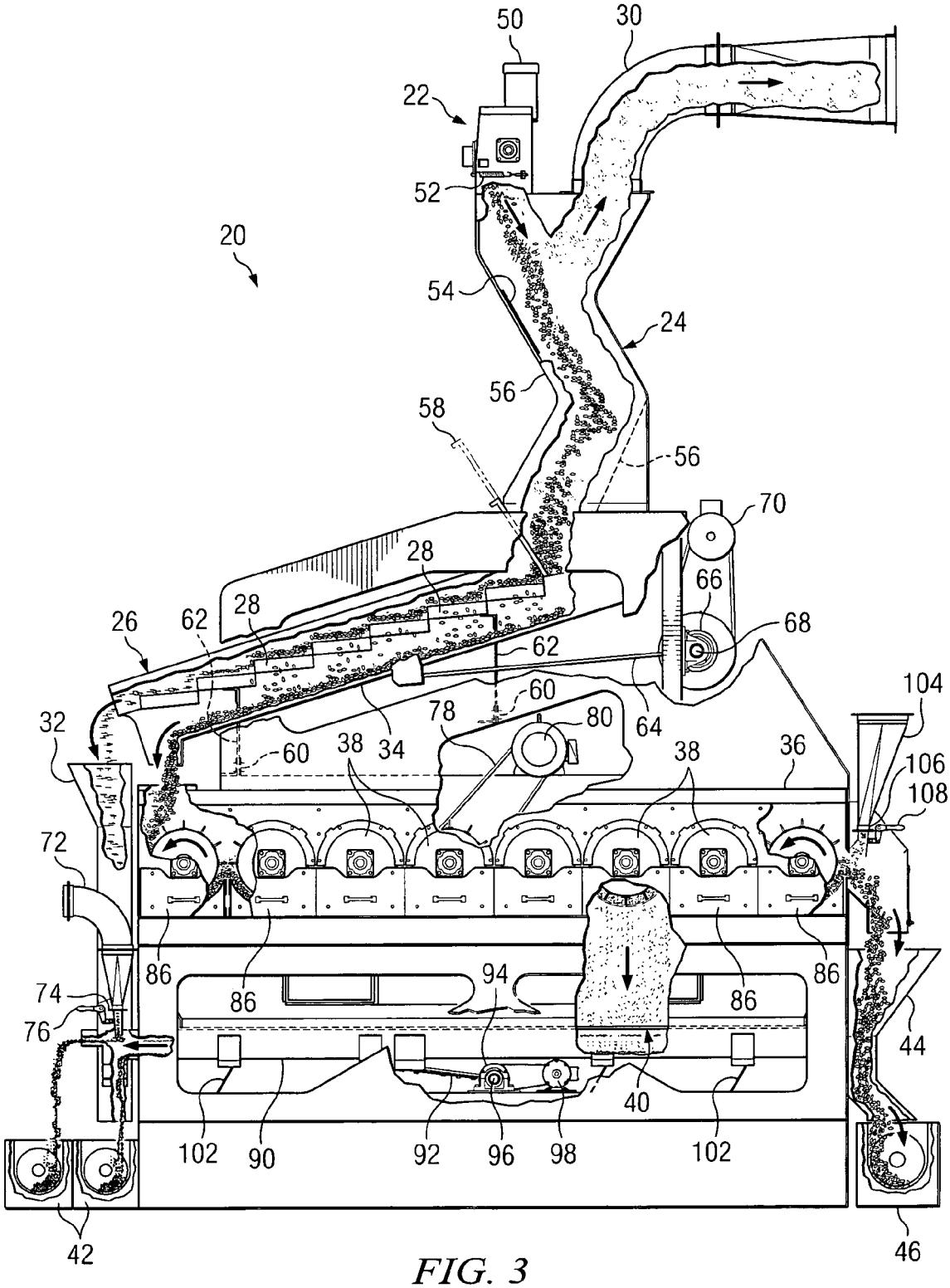
FIG. 3 is similar to FIG. 2 showing the apparatus of the present invention in use.

Referring now to the Drawings, and particularly to FIGS. 2 and 3 thereof, there is shown a cotton seed cleaner 20 incorporating the present invention. Dirty seeds are fed into the cleaner 20 through a metered feeder 22. The seeds fall through a vertical chute 24 and onto a shaker deck 26 containing a series of cascading shaker trays 28. As seeds fall down through the vertical chute 24, an airwash removes the majority of fly lint from the seeds and is extracted through a discharge duct 30.

At the bottom of the vertical chute 24 the substantially lint free seed travels down the series of cascading shaker trays 28. As the seeds progress down the cascading trays 28, large debris such as sticks, stems, cotton tufts, grabbots, and the like are scavenged off and fall into a discard chute 32 for collection and further processing. Having the larger debris removed, the seeds fall through perforated shaker trays 28 onto a slide 34. The seeds then fall off the end of the slide 34 into a housing 36 comprising a series of pin mill drums 38. Seeds progress through the pin mill drums 38 which remove any remaining debris. The remaining debris is discarded onto a vibrating table 40 located below the pin mill drums 38 where the debris is sorted further and carried into debris collection bins 42 located at the bottom of the discard chute 32 for extraction and further processing. After complete cleaning by pin mill drums 38 the seeds enter a collection chute 44 and fall into a clean seed collection bin 46 to await packaging or further processing.

Figure 4:
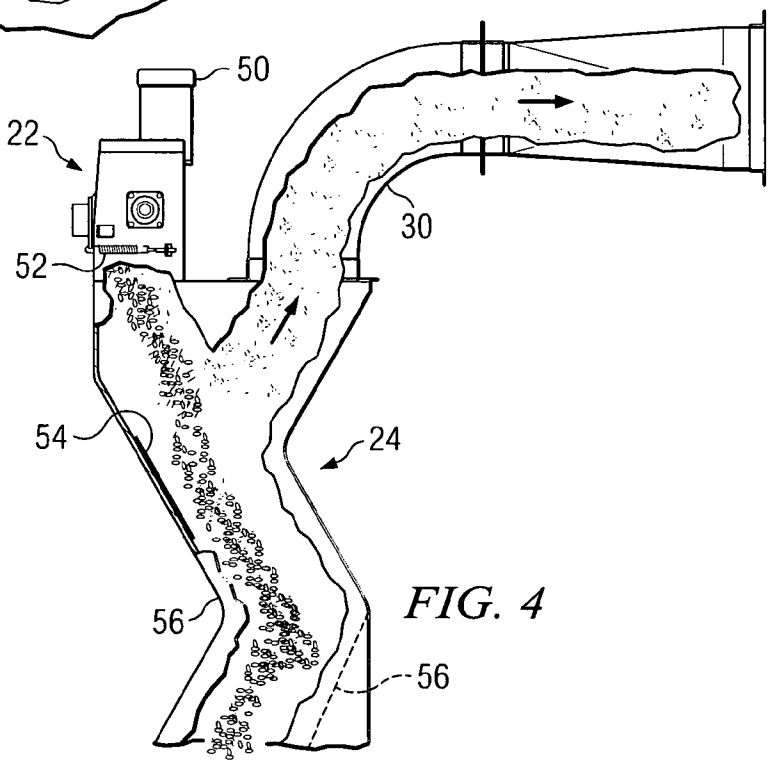
FIG. 4 is an enlarged view of one portion of the apparatus shown in FIG. 2.

As is best shown in FIG. 4, the seeds enter the vertical chute 24 through a metered feeder 22. A feeder motor 50 provides the power for the metered feeder 22. Located at the bottom of the metered feeder 22 is a spring-loaded panel 52 which prevents large debris such as concrete chunks, large rocks, scrap metal, and the like from entering into the cleaner 20. When the panel 52 catches a large debris item the metered feeder 22 pauses and triggers an alarm to alert an operator to remove the large debris item.

Located below the inlet of the vertical chute 24 is a removable plate magnet 54 which catches ferric debris thereby preventing it from continuing into the cleaning process. As the seeds fall down the vertical chute 24 a suction fan located at the end of a discharge duct 30 creates a counter-current airwash in the vertical chute 24 for removing fly lint and the lightest debris from the seeds. The lint and other light debris is removed through the discharge duct 30 for collection and further processing. The suction fan creating the airwash is sized according to the size of the cotton seed cleaner 20. For example, a cotton seed cleaner 20 comprising a vertical chute 24 having a diameter of 16 to 18 inches requires a 6500 CFM fan.

The vertical chute 24 is formed with two inclined panels 56. The inclined panels 56 help to break up any clumps or large wads of seeds so the seeds reach the shaker deck 26 in a more atomized and loose formation. Located at the bottom of the vertical chute 24 is a gate 58 which may be manually adjusted vertically to regulate the seed flow into the shaker deck 26. Two inspection windows 59 are located on the vertical chute for inspection of the seedflow therethrough.

Figure 5:
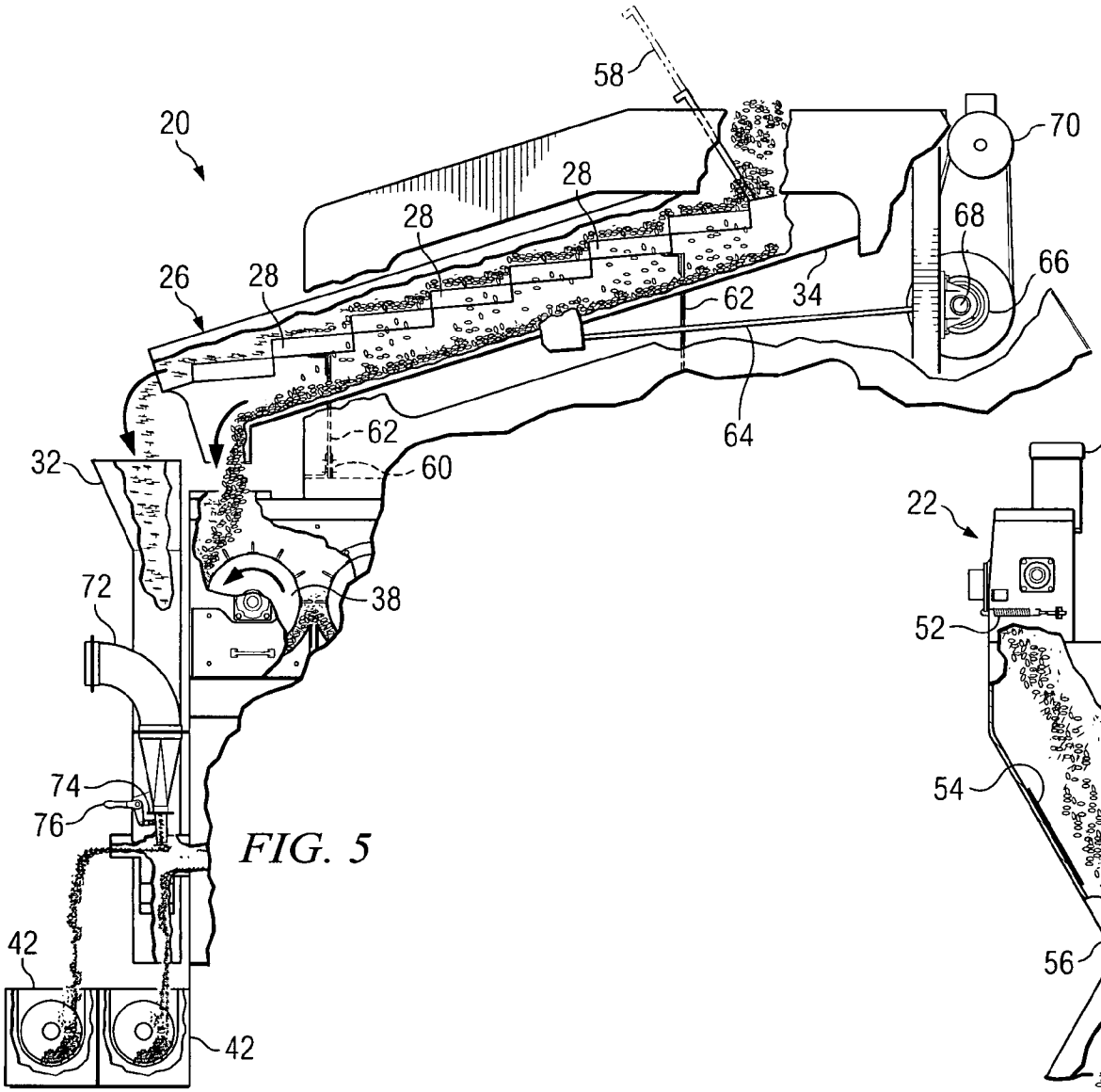
FIG. 5 is an enlarged view of another portion of the apparatus shown in FIG. 2.

FIG. 5 illustrates the seeds progressing through the shaker deck 26. The shaker trays 28 are fabricated from metal and have perforated top surfaces. The shaker trays 28 may also be fabricated from other rigid materials known to those skilled in the art and commonly used in the food processing industry. The perforations in the top surfaces of the shaker trays 28 are sized to allow only seeds to fit through. The preferred size of the perforations of the upper shaker trays 28 at the top of the shaker deck 26 is ⅝ inch +/−10%. The remaining shaker trays 28 have ¾ inch +/−10% sized perforations in the top surfaces thereof. As a result, the larger debris is scavenged from the seeds and the clean seeds fall through the perforations of the trays 28 onto the slide 34.

The shaker deck 26 is supported by angle irons 60 and leaf springs 62. The shaker trays 28 are agitated by an arm 64, which is oscillated by an eccentric 66 secured to a drive shaft 68 driven by a motor 70. The arm 64 threads into the eccentric 66 and is secured in place by a nut. The preferred embodiment comprises a shaker deck 26 which vibrates at a frequency of 500-550 RPM. The larger debris falls through the chute 32 to the debris collection bins 42 below. Any small or loose debris that does not fall into the collection bins 42 is carried away by a suction airwash into a duct 72. The airflow through the duct 72 is regulated by a damper 74 controlled by a handle 76 located above the debris collection bins 42. The preferred embodiment comprises a duct 72 having a diameter of 6 inches, requiring an airflow of 750 CFM.

Figure 6:
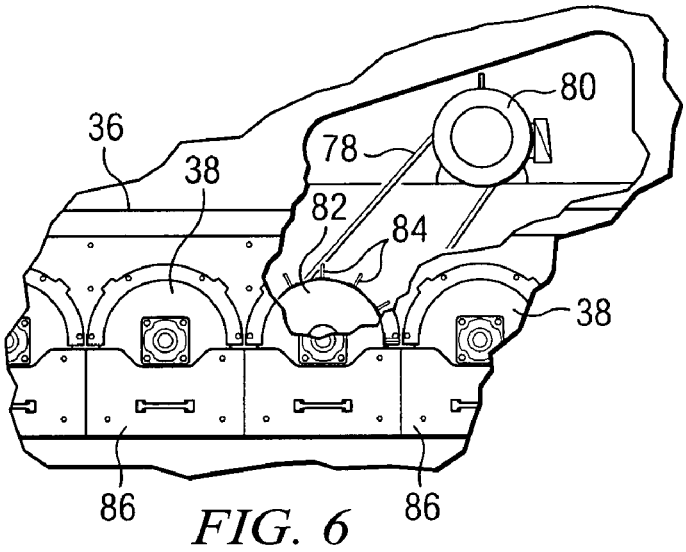
FIG. 6 is an enlarged view of yet another portion of the apparatus shown in FIG. 2.

At the end of the slide 34 the seeds continue into the housing 36 containing the series of pin mill drums 38. Referring specifically to FIG. 6, the series of pin mill drums 38 is driven by a belt 78 turned by a motor 80. A timing drive connects all of the pin mill drums 38 and causes all the pin mill drums 38 to rotate in the same direction, at a preferred rotation of 300-350 RPM.

Encased in each pin mill drum 38 is a wheel 82 with pins 84 protruding therefrom. The pins 84 fluff the seeds and loosen any remaining debris. The preferred embodiment comprises pins 84 which are ⅜ inch in diameter. Below each pin mill drum 38 are drawers 86 with perforated bottom surfaces. These drawers 86 may be fabricated from metals or other rigid materials known to those skilled in the art and suitable for use in the food processing industry. The perforations in the bottom surface of the drawers 86 are sized to prevent seed from passing through and allowing only debris sized smaller than the seeds to pass through. The preferred size of the perforations in the bottom of drawers 86 is 3/16 to 5/16 inch +/−10%.

Figure 7:
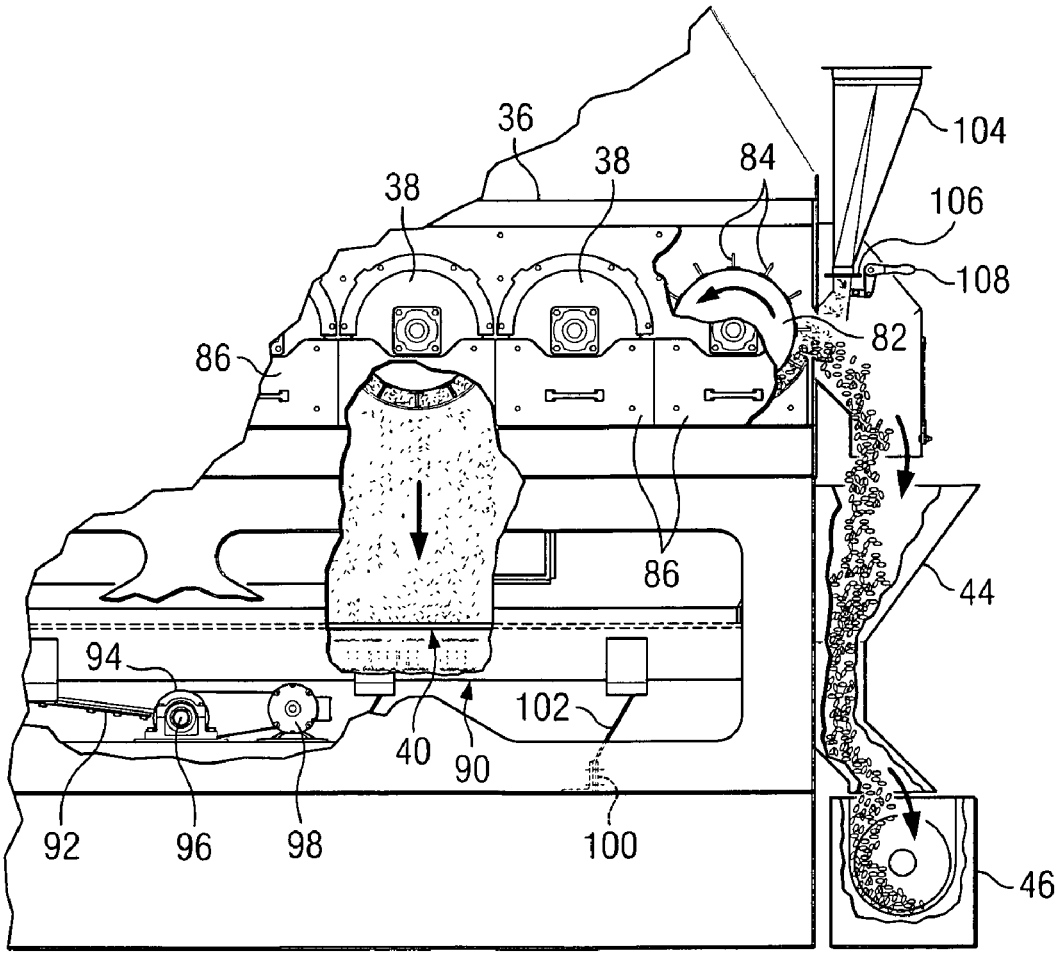
FIG. 7 is an enlarged view of yet another portion of the apparatus shown in FIG. 2.

As is best shown in FIG. 7 the smaller sized debris falls through the perforated bottom surface of the drawers 86 onto the vibrating table 40 located below the pin mill drums 38. The vibrating table 40 has a perforated surface and vibrates at a very high frequency, short stroke vibration, preferably 650-680 RPM. The vibrating table is vibrated by an arm 92 which is oscillated by an eccentric 94 on a small drive shaft 96 controlled by a motor 98. The perforations of the vibrating table 40 are sized to sort the small debris which has fallen from the pin mill drums 38. The preferred size of the perforations of the vibrating table 40 is 1/16 to ⅛ inch +/−10%. The smallest debris such as bran, sand, and dirt fall through the vibrating table 40 and onto a bottom chute 90 which carries the debris to the debris collection bins 42. The vibrating table 40 and bottom chute 90 are supported by a plurality of angle irons 100 and leaf springs 102.

When the seeds reach the end of the series of pin mill drums 38 they are completely clean of debris. Any remaining lint or loose debris that did not fall through the drawers 86 going through the pin mill drums 38 is separated and pulled into a vertical discharge duct 104 by an airwash caused by the same suction fan that created the airwash which is the vertical chute 24. The suction airflow into the vertical discharge duct 104 is regulated by a damper 106 controlled by an external handle 108. The preferred embodiment comprises a discharge duct 104 having a diameter of 10 inches, requiring an airflow of 1200 CFM. The completely cleaned seeds fall through the collection chute 44 and into a clean seed collection bin 46 for packaging and/or further processing.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. An apparatus for cleaning cotton seeds for industrial and commercial use comprising:

a vertical chute for receiving cotton seeds;

an airwash within the vertical chute for removing lint from seeds therein;

means for recovering lint removed by the airwash;

a series of cascading shaker trays beginning below the vertical chute for scavenging debris from seeds;

means for recovering the scavenged debris from the shaker trays;

means for recovering the cleaned seeds from the shaker trays;

a plurality of pin mill drums located below the cascading shaker trays for removing remaining debris from seeds;

means for recovering the debris removed from the seeds by the pin mill drums;

means for recovering lint removed by the pin mill drums; and means for collecting cleaned seeds emerging from the pin mill drums.

2. The apparatus for cleaning cotton seeds according to claim 1 wherein dirty seeds are fed into the apparatus by a metered seed feeder.

3. The apparatus for cleaning cotton seeds according to claim 2 wherein a metered seed feeder comprises a spring-loaded panel for catching large debris and preventing said debris from entering the vertical chute at the beginning of the cleaning process.

4. The apparatus for cleaning cotton seeds according to claim 1 wherein a removable plate magnet for catching ferric debris is located at the inlet to the vertical chute.

5. The apparatus for cleaning cotton seeds according to claim 1 wherein the means for recovering the lint removed in the airwash is a discharge duct with a suction fan located at the end thereof.

6. The apparatus for cleaning cotton seeds according to claim 1 wherein the vertical chute comprises inclined panels for breaking up clumps or wads of seed so that the seeds reach the cascading shaker trays in an atomized and loose configuration.

7. The apparatus for cleaning cotton seeds according to claim 1 wherein the shaker trays have perforated bottom surfaces for sorting cleaned seeds therethrough.

8. The apparatus for cleaning cotton seeds according to claim 1 wherein the means for recovering the debris scavenged off of the seeds by the series of shaker trays is a chute with a bin located therebelow.

9. The apparatus for cleaning cotton seeds according to claim 1 wherein the means for recovering the cleaned seeds from the shaker trays is a slide which directs the seeds into the plurality of pin mill drums.

10. The apparatus for cleaning cotton seeds according to claim 1 wherein the plurality of pin mill drums comprise drawers with perforated bottom surfaces located directly beneath each pin mill drum for sorting debris therethrough.

11. The apparatus for cleaning cotton seeds according to claim 1 wherein the means for recovering the debris removed by the pin mill drums is a vibrating table which further sorts the removed debris.

12. The apparatus for cleaning cotton seeds according to claim 11 wherein sorted debris is then deposited into collection bins.

13. The apparatus for cleaning cotton seeds according to claim 1 wherein the means for recovering lint removed by the pin mill drums is an airwash created by a suction fan which pulls the lint into a discharge duct.

14. The apparatus for cleaning cotton seeds according to claim 1 wherein means for recovering the cleaned cotton seeds emerging from the pin mill drums is a collection chute with a collection bin located at the bottom thereof.

15. A method for cleaning cotton seeds for industrial and commercial use comprising the steps of:

providing a flow of initially dirty cotton seeds;

providing an airwash for removing lint from the flowing seeds;

recovering lint removed by the airwash;

providing a series of shaker trays in a cascading configuration below the airwash;

utilizing the shaker trays for scavenging debris from the seeds;

recovering debris removed by the shaker trays;

recovering the debris-scavenged seeds from the shaker trays;

providing a plurality of pin mill drums;

utilizing the pin mill drums for removing remaining debris from seeds;

collecting debris removed by the pin mill drums;

collecting lint removed by the pin mill drums; and collecting cleaned seeds from the pin mill drums.

16. The method for cleaning cotton seeds according to claim 15 including the additional step of providing a metered seed feeder and utilizing the metered seed feeder to control the flow of seeds into the airwash.

17. The method for cleaning cotton seeds according to claim 15 including the additional step of recovering large debris items inside the metered feeder.

18. The method for cleaning cotton seeds according to claim 15 including the additional step of collecting metallic debris prior to the airwash.

19. The method for cleaning cotton seeds according to claim 15 including the additional step of sorting debris removed by the plurality of pin mill drums.

* * * * *